US005441164A

United States Patent [19]

Beck et al.

[11] Patent Number: 5,441,164

[45] Date of Patent: Aug. 15, 1995

[54] COMBINATION FOOD AND BEVERAGE PLATE

[76] Inventors: Heinz Beck, 21752 Montbury, Lake Forest, Calif. 92630; Michael D. Beck, 5160 North Grey Mountain Trail, Tucson, Ariz. 85715

[21] Appl. No.: 214,434

[22] Filed: Mar. 18, 1994

[51] Int. Cl.[6] ..... B65D 25/30

[52] U.S. Cl. ..... 220/575; 220/574; 220/771; 220/737

[58] Field of Search ..... 220/575, 574, 755, 771, 220/737, 738, 755

[56] References Cited

U.S. PATENT DOCUMENTS

| | | | |
|---|---|---|---|
| 2,107,381 | 2/1938 | Leppke | 220/575 |
| 2,174,586 | 10/1939 | Keppke | 220/575 |
| 2,677,350 | 5/1954 | Prestidne et al. | 220/575 |
| 2,928,567 | 3/1960 | Davis | 220/575 |
| 3,773,212 | 12/1973 | Sekuler | 220/575 |
| 5,071,002 | 12/1991 | Bradley | 220/738 |
| 5,219,140 | 6/1993 | Spykerman | 220/738 |
| 5,353,952 | 10/1994 | Donche | 220/575 |

FOREIGN PATENT DOCUMENTS

| | | | |
|---|---|---|---|
| 303689 | 12/1936 | Italy | 220/575 |

*Primary Examiner*—Joseph Man-Fu Moy

[57] ABSTRACT

A combination food and beverage plate has a generally circular bottom section with an upper surface and a lower surface. A generally cylindrically shaped side wall is contiguous with and extends upwardly from the perimeter of the upper surface of the bottom section. A generally cylindrically shaped support cylinder is contiguous with and extends upwardly from the upper surface of the bottom section. The support cylinder includes an opening at its upper extent. A plurality of planar, generally rectangular shaped food dividers are contiguous with and extend upwardly from the upper surface of the bottom section. Each divider has an inner edge and an outer edge, with the inner edge abutting the center support cylinder and extending radially outwardly therefrom. The outer edge of the divider abuts the side wall.

1 Claim, 3 Drawing Sheets

FIG. 1
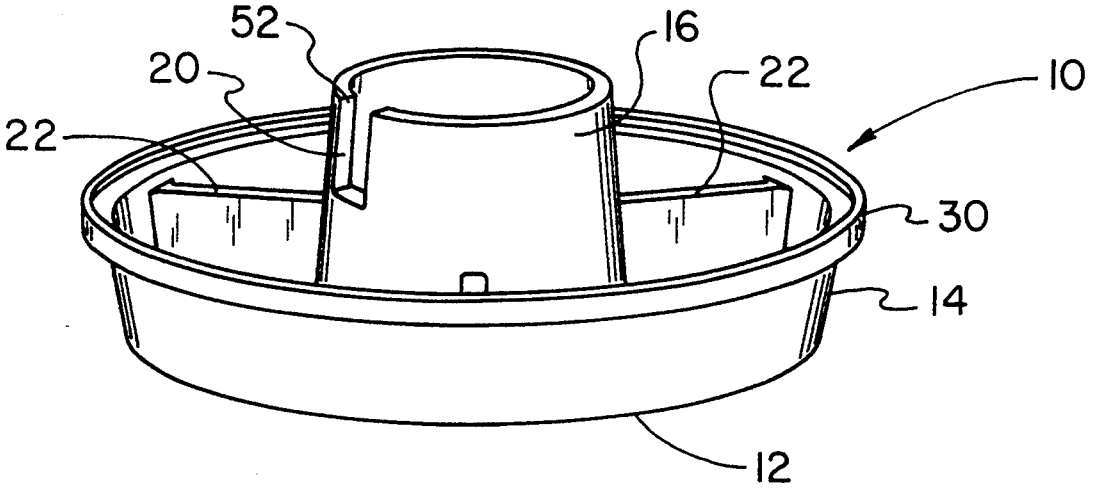
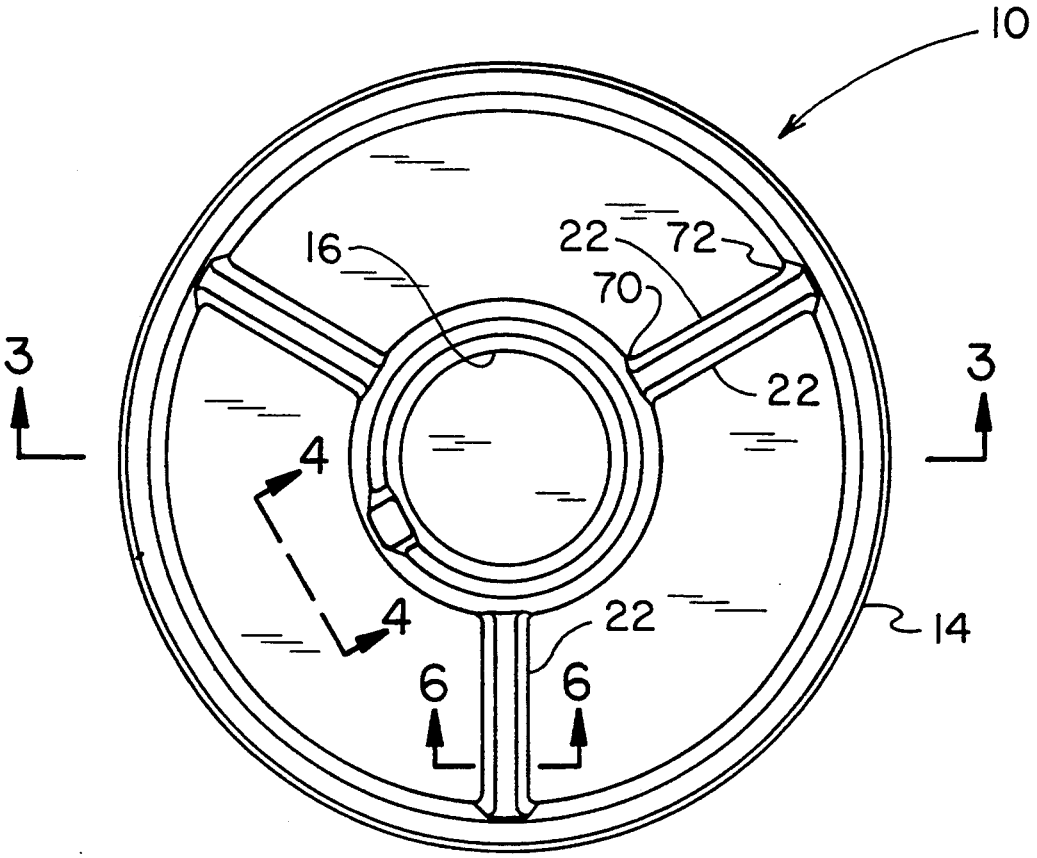
FIG. 2

COMBINATION FOOD AND BEVERAGE PLATE

BACKGROUND OF THE INVENTION

1. Field of the Invention

The present invention relates to combination food and beverage plates and more particularly pertains to supporting beverages with a high center support cylinder to prevent spillage into food compartments.

2. Description of the Prior Art

The use of plate and cup holders is known in the prior art. More specifically, plate and cup holders heretofore devised and utilized for the purpose of carrying and transporting food plates and beverage cups are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,119,967 to Ercolani, a one handed controllable plate and cup holder.

U.S. Pat. No. 5,111,960 to Zilliox discloses an interlocking plate and cup set.

U.S. Pat. No. 3,545,642 to Swett discloses a compartmented dish.

U.S. Pat. No. 4,785,959 to Kleiner discloses a combination cup and plate holder.

Lastly, U.S. Pat. No. Des. 307,529 to Baetens discloses the ornamental design of a combined picnic plate and cup holder.

In this respect, the combination food and beverage plates according to the present invention substantially departs from the conventional concepts and designs of the prior art, and in doing so provides an apparatus primarily developed for the purpose of supporting beverages with a high center support cylinder to prevent spillage into food compartments.

Therefore, it can be appreciated that there exists a continuing need for new and improved combination food and beverage plates which can be used for supporting beverages with a high center support cylinder to prevent spillage into food compartments. In this regard, the present invention substantially fulfills this need.

SUMMARY OF THE INVENTION

In view of the foregoing disadvantages inherent in the known types of plate and cup holders now present in the prior art, the present invention provides an improved combination food and beverage plates. As such, the general purpose of the present invention, which will be described subsequently in greater detail, is to provide a new and improved combination food and beverage plates and method which has all the advantages of the prior art and none of the disadvantages.

To attain this, the present invention essentially comprises a new and improved combination food and beverage plate comprising a planar circular bottom section with an upper surface and a lower surface. A generally cylindrically shaped side wall is contiguous with and extends upwardly from the perimeter of the upper surface of the bottom section. The side wall is angled upward and outward with respect to the plane of the plate at about one hundred and ten degrees. The side wall also has a curved ledge at its upper extent which extends a short distance further from the perimeter of the plate than the remainder of the side wall. A generally cylindrically shaped center support cylinder is contiguous with and extends upwardly from the central portion of the upper surface of the bottom section. The center support cylinder has an opening at its upper extent. The center support cylinder consists of an inner cylindrical wall and an outer cylindrical wall which meet at their upper extents to form a circumfrential groove in an inverted V-shape configuration. Both cylindrical walls measure between about two and three inches in height. The inner cylindrical wall extends upward and outward from the central portion of the bottom section at about a one hundred degree angle with respect to the plane of the bottom section. The outer cylindrical wall extends upward and toward the central portion of the bottom section at about an eighty degree angle with respect to the plane of the plate. The cylindrical walls are separated by a short distance at their lower extent. A cup handle slot depends downwardly from the upper extent of the center support cylinder. The slot has a generally rectangular shape with an open end even with the upper perimeter of the center support cylinder. Three planar, generally rectangular shaped food dividers are contiguous with and extend upward from the upper surface of the bottom section. Each food divider is positioned equidistantly from the others and is comprised of two walls, with the lower extent of the food divider walls being located a short distance from each other. The two walls are slanted toward each other and meet at their upper extent to form a radial groove in an inverted V-shape configuration. Each divider has an inner edge and an outer edge. The inner edge abuts the center support cylinder and extends radially outwardly therefrom, with the outer edge abutting the side wall.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved combination food and beverage plates which have all the advantages of the prior art plate and cup holders and none of the disadvantages.

It is another object of the present invention to provide new and improved combination food and beverage plates which may be easily and efficiently manufactured and marketed.

It is further object of the present invention to provide new and improved combination food and beverage plates which are of durable and reliable constructions.

An even further object of the present invention is to provide new and improved combination food and beverage plates which are susceptible of a low cost of manufacture with regard to both materials and labor, and which accordingly are then susceptible of low prices of sale to the consuming public, thereby making such combination food and beverage plates economically available to the buying public.

Still yet another object of the present invention is to provide new and improved combination food and beverage plates which provide in the apparatuses and methods of the prior art some of the advantages thereof, while simultaneously overcoming some of the disadvantages normally associated therewith.

Still another object of the present invention is to support beverages with a high center support cylinder to prevent spillage into food compartments.

Lastly, it is an object of the present invention to provide new and improved combination food and beverage plates having a generally circular bottom section with an upper surface and a lower surface. A generally cylindrically shaped side wall is contiguous with and extends upwardly from the perimeter of the upper surface of the bottom section. A generally cylindrically shaped support cylinder is contiguous with and extends upwardly from the upper surface of the bottom section. The support cylinder includes an opening at its upper extent. A plurality of planar, generally rectangular shaped food dividers are contiguous with and extend upwardly from the upper surface of the bottom section. Each divider has an inner edge and an outer edge, with the inner edge abutting the center support cylinder and extending radially outwardly therefrom. The outer edge of the divider abuts the side wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the combination food and beverage plates constructed in accordance with the principles of the present invention.

FIG. 2 is a top plan view of the combination food and beverage plates shown in FIG. 1.

The same reference numerals refer to the same parts through the various Figures.

DESCRIPTION OF THE PREFERRED EMBODIMENT

Figure 3:
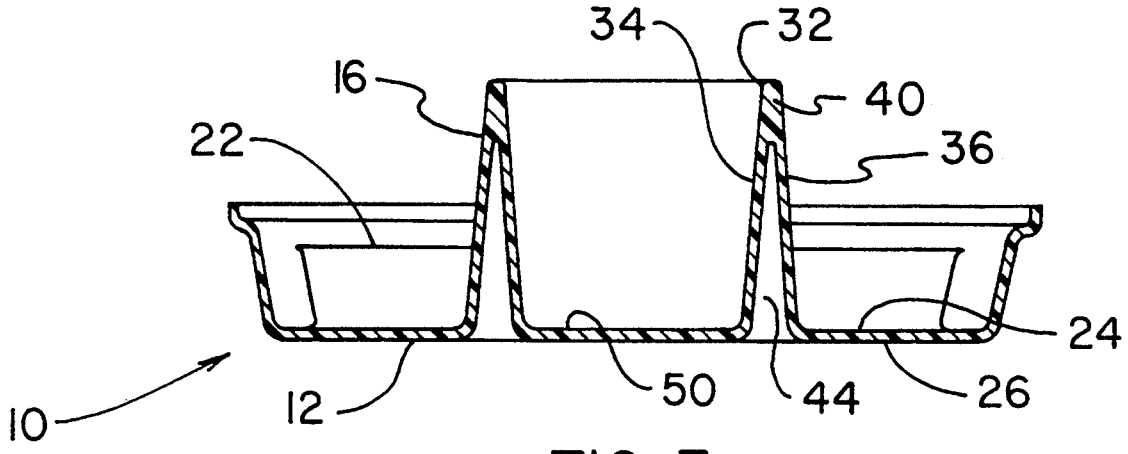
FIG. 3 is a cross sectional view of the plate taken along line 3—3 FIG. 2.

With reference now to the drawings, and in particular to FIG. 1 thereof, the preferred embodiment of the new and improved combination food and beverage plates embodying the principles and concepts of the present invention and generally designated by the reference numeral 10 will be described.

Figure 4:
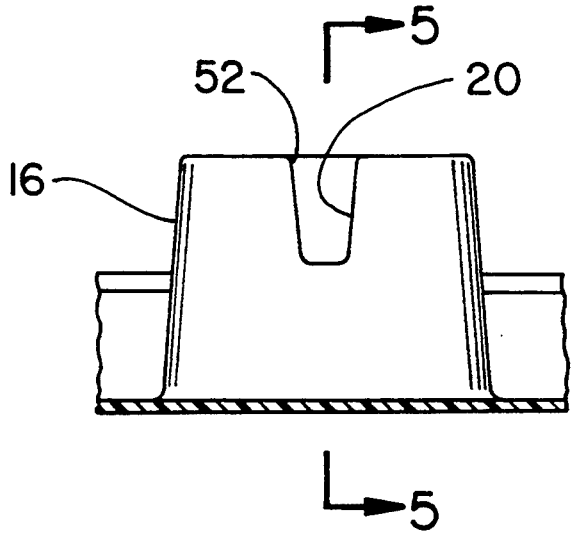
FIG. 4 is a broken away, cross sectional view of the plate taken along line 4—4 of FIG. 2 depicting the cup handle slot.
Figure 5:
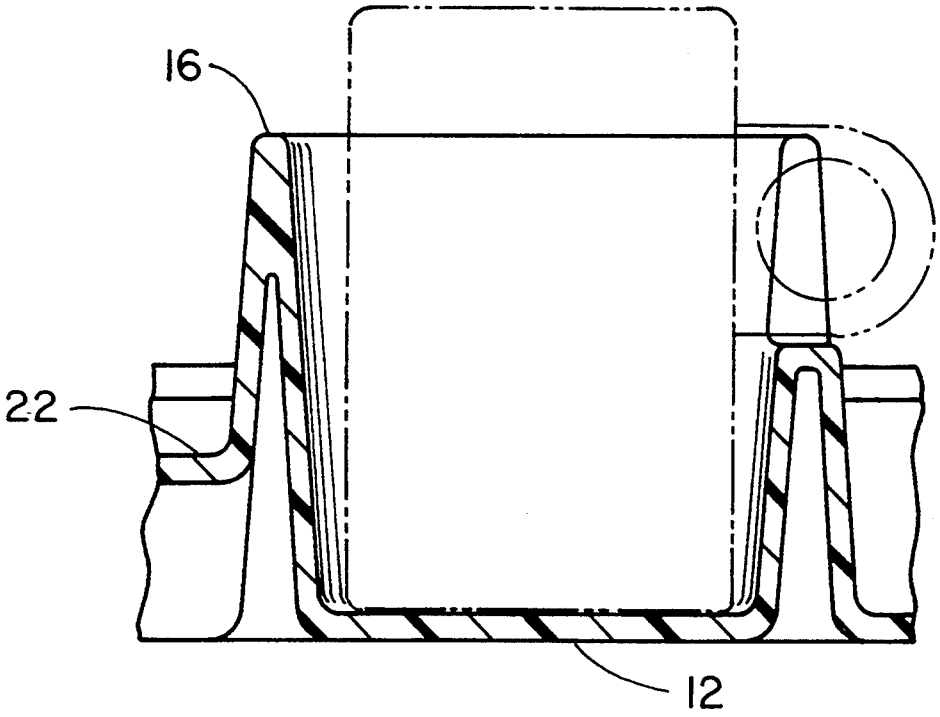
FIG. 5 is a broken away, exploded cross sectional view of the plate taken along line 5—5 of FIG. 4 depicting the cup holder and cup handle slot.
Figure 6:
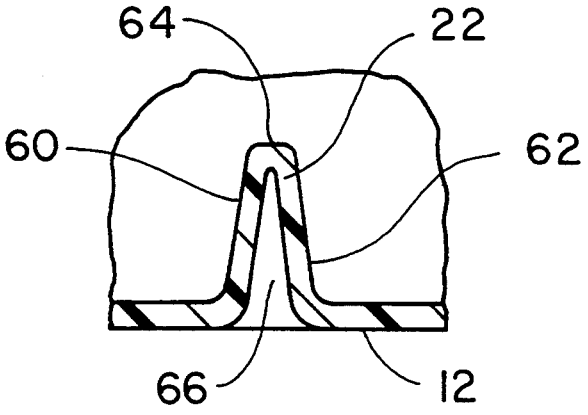
FIG. 6 is a broken away, cross sectional view of the plate taken along line 6—6 of FIG. 2 depicting an isolated view of a food divider.

Specifically, it will be noted in FIGS. 1 through 6, that there is provided a new and improved combination food and beverage plate 10. The combination food and beverage plate, in its broadest context, comprises a bottom section 12, a side wall 14, a center support cylinder 16, a cup handle slot 20 and three food dividers 22.

More specifically, the planar circular bottom section 12 has an upper surface 24 and a lower surface 26.

A generally cylindrically shaped side wall 14 is contiguous with and extends upwardly from the perimeter of the upper surface 24 of the bottom section 12. The side wall 14 is angled upward and outward with respect to the plane of the plate at about one hundred and ten degrees. The side wall 14 also has a curved ledge 30 at its upper extent which extends a short distance further from the perimeter of the plate than the remainder of the side wall 14. The ledge is provided to help prevent slippage and spills.

A generally cylindrically shaped center support cylinder 16 is contiguous with and extends upwardly from the central portion 50 of the upper surface 24 of the bottom section. The center support cylinder 16 has an opening at its upper extent 32. The center support cylinder consists of an inner cylindrical wall 34 and an outer cylindrical wall 36 which meet at their upper extents 40 to form a circumfrential groove 44 in an inverted V-shape configuration. Both cylindrical walls 34, 36 measure between about two and three inches in height. The inner cylindrical wall 34 extends upward and outward from the central portion 50 of the bottom section at about a one hundred degree angle with respect to the plane of the bottom section 12. The outer cylindrical wall 36 extends upward and toward the central portion 50 of the bottom section at about an eighty degree angle with respect to the plane of the bottom section. The cylindrical walls 34, 36 are separated by a short distance at their lower extent. The center support cylinder is adapted to support a cup with or without a handle.

A cup handle slot 20 depends downwardly from the upper extent 32 of the center support cylinder 16. The slot 20 has a generally rectangular shape with an open end 52 even with the upper perimeter of the center support cylinder 16.

Three planar, generally rectangular shaped food dividers 22 are contiguous with and extend upward from the upper surface 24 of the bottom section. Each food divider 22 is positioned equidistantly from the others and is comprised of two walls 60, 62, with the lower extent of the food divider walls 60, 62 being located a short distance from each other. The two walls 60, 62 are slanted toward each other and meet at their upper extent 64 to form a radial groove 66 in an inverted V-shape configuration. Each divider has an inner edge 70 and an outer edge 72. The inner edge 70 abuts the center support cylinder 16 and extends radially outwardly therefrom, with the outer edge 72 abutting the side wall.

The combination food and beverage plate was developed to overcome the problem of where to place a drink when obtaining food at conventions, exhibits, and other standing room only gatherings. The plate can be held with one hand leaving the other hand free for eating, drinking, smoking, etc. A major feature the plate is the two and one-half inch high center support cylinder. The center support cylinder includes a cup handle slot to permit the user to place a cup therein in addition to a can or bottle. Drinks are prevented from falling due to the height of the cylinder. The inverted V-shape grooves in the plate allow easy stackability. The plate may be manufactured from paper or plastics for one time use, or manufactured from more permanent materials for multiple uses. The center support cylinder has a diameter sufficiently large to accommodate a wide variety of cans, bottles and cups. The plate has a diameter of between nine and twelve inches and can be produced with none or several dividers to separate food.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved combination food and beverage plate comprising, in combination:

a planar bottom section with an upper surface and a lower surface;

a generally cylindrically shaped side wall contiguous with and extending upward from the perimeter of the upper surface of the bottom section, the side wall being angled upward and outward with respect to the plane of the plate at about one hundred and ten degrees, the side wall also having a curved ledge at its upper extent extending a short distance further from the perimeter of the plate than the remainder of the side wall;

a generally cylindrically shaped center support cylinder contiguous with and extending upward from the central portion of the upper surface of the bottom section, the center support cylinder having an opening at its upper extent and consisting of an inner cylindrical wall and an outer cylindrical wall which meet at their upper extents to form a circumferential groove in an inverted V-shape configuration, the circumferential groove being shaped to permit snug stacking of multiple plates, with both cylindrical walls measuring between about two and three inches in height, the inner cylindrical wall extending upward and outward from the central portion of the bottom section at about a one hundred degree angle with respect to the plane of the bottom section, with the outer cylindrical wall extending upward and toward the central portion of the bottom section at about an eighty degree angle with respect to the plane of the plate, with the cylindrical walls being separated by a short distance at their lower extent;

a cup handle slot depending downwardly from the upper extent of the center support cylinder, the slot having a generally rectangular shape with an open end even with the upper perimeter of the center support cylinder the slot measuring about one-half the height of the cylinder and wide enough to provide clearance for a cup handle in the operative orientation;

three planar, generally rectangular shaped food dividers contiguous with and extending upward from the upper surface of the bottom section, each food divider being positioned equidistantly from the others and comprised of two walls, with the lower extent of the food divider walls being located a short distance from each other, with the two walls being slanted toward each other and meeting at their upper extent to form a radial groove in an inverted V-shape configuration, the radial grooves being shaped to permit snug stacking of multiple plates, each divider having an inner edge and an outer edge, with the inner edge abutting the center support cylinder and extending radially outwardly therefrom, with the outer edge abutting the side wall, the area between the food dividers encompassing the entire surface area of the bottom section.

* * * * *